US008894593B2

(12) United States Patent
Ikeyama et al.

(10) Patent No.: US 8,894,593 B2
(45) Date of Patent: Nov. 25, 2014

(54) MASSAGING DEVICE

(75) Inventors: Kazuyuki Ikeyama, Kanagawa (JP); Mieko Nasu, Kanagawa (JP); Hiroshi Fukui, Kanagawa (JP); Takuya Saiwaki, Tokyo (JP)

(73) Assignee: Shiseido Company, Ltd., Tokyo (JP)

( * ) Notice: Subject to any disclaimer, the term of this patent is extended or adjusted under 35 U.S.C. 154(b) by 24 days.

(21) Appl. No.: 13/517,188

(22) PCT Filed: Dec. 15, 2010

(86) PCT No.: PCT/JP2010/072574

§ 371 (c)(1),
(2), (4) Date: Jun. 19, 2012

(87) PCT Pub. No.: WO2011/078034

PCT Pub. Date: Jun. 30, 2011

(65) Prior Publication Data

US 2012/0253243 A1 Oct. 4, 2012

(30) Foreign Application Priority Data

Dec. 22, 2009 (JP) ..... 2009-290418

(51) Int. Cl.

| | |
|---|---|
| ***A61H 1/00*** | (2006.01) |
| ***A61H 7/00*** | (2006.01) |
| ***A61H 23/02*** | (2006.01) |
| *A61H 15/00* | (2006.01) |

(52) U.S. Cl.

CPC .... *A61H 23/0263* (2013.01); *A61H 2201/1692* (2013.01); *A61H 2230/00* (2013.01); *A61H 2015/0071* (2013.01); *A61H 2201/165* (2013.01); *A61H 2201/1661* (2013.01); *A61H 2201/1604* (2013.01); *A61H 2205/022* (2013.01); *A61H 7/007* (2013.01); *A61H 2023/0272* (2013.01)

USPC ..... 601/67; 601/46; 601/62; 601/71; 601/79

(58) Field of Classification Search

CPC ..... A61H 23/0263; A61H 2201/1692; A61H 2201/1661; A61H 2205/022; A61H 7/007; A61H 2230/00; A61H 2015/0071; A61H 2023/0272; A61H 2201/165; A61H 2201/1604

USPC ..... 601/1, 46, 49, 53–54, 56, 59, 65–72, 601/78–81, 134–135, 15, 58, 60–62, 34, 601/138; 140/3 CA, 71 C, 89

See application file for complete search history.

(56) References Cited

U.S. PATENT DOCUMENTS 3,364,922 A * 1/1968 Teranishi ..... 601/72
3,763,853 A 10/1973 Jochimski (Continued)

FOREIGN PATENT DOCUMENTS

GB 2 294 393 A 5/1996
JP 59-14854 1/1984

(Continued)

OTHER PUBLICATIONS

Kazuyuki Ikeyama, et al., "Neuronal Nitric Oxide Synthase in Epidermis is Involved in Cutaneous Circulatory Response to Mechanical Stimulation", 2009, Journal of Investigative Dermatology pp. 1-9.
Office Action in Japanese Patent Application No. 2009-290418 mailed Feb. 1, 2011.

(Continued)

*Primary Examiner* — Justine Yu
*Assistant Examiner* — Douglas Sul
(74) *Attorney, Agent, or Firm* — IPUSA, PLLC

(57) ABSTRACT

A massaging device includes a base part, vibrators configured to be brought into contact with target parts of a user and to massage the target parts with vibration, and springs each including a first end fixed to the base part and a second end attached to the corresponding one of the vibrators. The spring constants of the springs are set based on skin stress of the target parts.

5 Claims, 23 Drawing Sheets

(56) References Cited

U.S. PATENT DOCUMENTS

| | | | | |
|---|---|---|---|---|
| 4,846,158 | A | 7/1989 | Teranishi | |
| 5,088,474 | A | 2/1992 | Mabuchi et al. | |
| 5,542,907 | A * | 8/1996 | Chou | 601/46 |
| 6,052,852 | A * | 4/2000 | Huang | 5/693 |
| 6,241,695 | B1 * | 6/2001 | Dabir | 601/136 |
| 6,305,040 | B1 * | 10/2001 | Myler | 5/636 |
| 6,511,446 | B1 * | 1/2003 | Wu | 601/15 |
| 6,910,360 | B2 * | 6/2005 | Stjepan et al. | 72/140 |
| 7,618,393 | B2 * | 11/2009 | Bingham et al. | 604/68 |
| 7,985,190 | B2 * | 7/2011 | Gruber et al. | 601/46 |
| 8,128,583 | B2 * | 3/2012 | Ghatge | 601/134 |
| 2001/0051777 | A1 | 12/2001 | Nakayama | |
| 2005/0113725 | A1 * | 5/2005 | Masuda | 601/72 |
| 2005/0203446 | A1 | 9/2005 | Takashima | |
| 2009/0076422 | A1 * | 3/2009 | Wong et al. | 601/134 |

FOREIGN PATENT DOCUMENTS

| | | |
|---|---|---|
| JP | 63-092632 | 6/1988 |
| JP | 02-185251 | 7/1990 |
| JP | 05-184639 | 7/1993 |
| JP | 10-028709 | 2/1998 |
| JP | 2001-000503 | 1/2001 |
| JP | 2001-346845 | 12/2001 |
| JP | 2005-230399 | 9/2005 |
| JP | 2005-237544 | 9/2005 |
| JP | 2005-296378 | 10/2005 |
| JP | 2009-204452 | 9/2009 |
| JP | 2009-240768 | 10/2009 |

OTHER PUBLICATIONS

International Search Report mailed on Feb. 8, 2011.
Extended European Search Report mailed Aug. 9, 2013.

* cited by examiner (A)

(B)

| | | | |
|---|---|---|---|
| 0.28 | 0.22 | 0.23 | 0.41 |
| 0.26 | 0.21 | 0.19 | 0.26 |
| 0.22 | 0.17 | 0.18 | 0.15 |
| 0.07 | 0.06 | 0.14 | 0.12 |
| 0.05 | 0.09 | 0.12 | 0.13 |
| 0.07 | 0.08 | 0.14 | 0.14 |
| 0.14 | 0.16 | 0.15 | 0.09 |

| LESS THAN 0.1 | GREATER THAN OR EQUAL TO 0.1 AND LESS THAN 0.2 | GREATER THAN OR EQUAL TO 0.2 AND LESS THAN 0.3 | GREATER THAN OR EQUAL TO 0.3 |
|---|---|---|---|
| SOFT | RELATIVELY SOFT | RELATIVELY HARD | HARD |

(A)

(B)

| | | | |
|---|---|---|---|
| 0.19 | 0.24 | 0.30 | 0.29 |
| 0.17 | 0.18 | 0.2 | 0.2 |
| 0.06 | 0.05 | 0.05 | 0.06 |
| 0.09 | 0.07 | 0.06 | 0.06 |
| 0.16 | 0.07 | 0.06 | 0.06 |
| 0.17 | 0.13 | 0.07 | 0.06 |
| 0.14 | 0.14 | 0.12 | 0.15 |

| LESS THAN 0.1 | GREATER THAN OR EQUAL TO 0.1 AND LESS THAN 0.2 | GREATER THAN OR EQUAL TO 0.2 AND LESS THAN 0.3 | GREATER THAN OR EQUAL TO 0.3 |
|---|---|---|---|
| SOFT | RELATIVELY SOFT | RELATIVELY HARD | HARD |

(A)

(B)

| | | | |
|---|---|---|---|
| 0.26 | 0.29 | 0.32 | 0.35 |
| 0.24 | 0.22 | 0.24 | 0.29 |
| 0.18 | 0.17 | 0.25 | 0.25 |
| 0.14 | 0.09 | 0.08 | 0.11 |
| 0.14 | 0.09 | 0.07 | 0.1 |
| 0.12 | 0.08 | 0.08 | 0.09 |
| 0.13 | 0.1 | 0.1 | 0.09 |

| LESS THAN 0.1 | GREATER THAN OR EQUAL TO 0.1 AND LESS THAN 0.2 | GREATER THAN OR EQUAL TO 0.2 AND LESS THAN 0.3 | GREATER THAN OR EQUAL TO 0.3 |
|---|---|---|---|
| SOFT | RELATIVELY SOFT | RELATIVELY HARD | HARD |

(A)

(B)

| | | | |
|---|---|---|---|
| 0.26 | 0.33 | 0.36 | 0.32 |
| 0.2 | 0.19 | 0.26 | 0.25 |
| 0.12 | 0.14 | 0.16 | 0.14 |
| 0.09 | 0.09 | 0.07 | 0.08 |
| 0.08 | 0.08 | 0.07 | 0.06 |
| 0.06 | 0.09 | 0.07 | 0.06 |
| 0.12 | 0.12 | 0.14 | 0.15 |

| LESS THAN 0.1 | GREATER THAN OR EQUAL TO 0.1 AND LESS THAN 0.2 | GREATER THAN OR EQUAL TO 0.2 AND LESS THAN 0.3 | GREATER THAN OR EQUAL TO 0.3 |
|---|---|---|---|
| SOFT | RELATIVELY SOFT | RELATIVELY HARD | HARD |

(A)

(B)

| | | | |
|---|---|---|---|
| 0.23 | 0.27 | 0.3 | 0.36 |
| 0.19 | 0.23 | 0.27 | 0.26 |
| 0.09 | 0.15 | 0.16 | 0.15 |
| 0.06 | 0.05 | 0.07 | 0.08 |
| 0.07 | 0.05 | 0.05 | 0.08 |
| 0.08 | 0.08 | 0.06 | 0.06 |
| 0.1 | 0.1 | 0.1 | 0.11 |

| LESS THAN 0.1 | GREATER THAN OR EQUAL TO 0.1 AND LESS THAN 0.2 | GREATER THAN OR EQUAL TO 0.2 AND LESS THAN 0.3 | GREATER THAN OR EQUAL TO 0.3 |
|---|---|---|---|
| SOFT | RELATIVELY SOFT | RELATIVELY HARD | HARD |

(A)

(B)

| | | | |
|---|---|---|---|
| 0.21 | 0.29 | 0.34 | 0.37 |
| 0.16 | 0.21 | 0.27 | 0.29 |
| 0.11 | 0.13 | 0.15 | 0.16 |
| 0.09 | 0.11 | 0.12 | 0.11 |
| 0.11 | 0.1 | 0.11 | 0.11 |
| 0.09 | 0.09 | 0.09 | 0.08 |
| 0.13 | 0.11 | 0.12 | 0.12 |

| LESS THAN 0.1 | GREATER THAN OR EQUAL TO 0.1 AND LESS THAN 0.2 | GREATER THAN OR EQUAL TO 0.2 AND LESS THAN 0.3 | GREATER THAN OR EQUAL TO 0.3 |
|---|---|---|---|
| SOFT | RELATIVELY SOFT | RELATIVELY HARD | HARD |

FIG.15

| SKIN STRESS (g) | | WIRE DIAMETER (mm) | SPRING CONSTANT (N/mm) |
|---|---|---|---|
| 0.3 – | HARD | 0.75 – 0.8 mm IN PRESENT EMBODIMENT | 1 – |
| 0.2 – 0.3 | RELATIVELY HARD | 0.65 – 0.75 0.7 mm IN PRESENT EMBODIMENT | 0.4 – 1 |
| 0.1 – 0.2 | RELATIVELY SOFT | 0.53 – 0.65 0.6 mm IN PRESENT EMBODIMENT | 0.2 – 0.4 |
| – 0.1 | SOFT | – 0.53 0.5 mm IN PRESENT EMBODIMENT | – 0.2 |

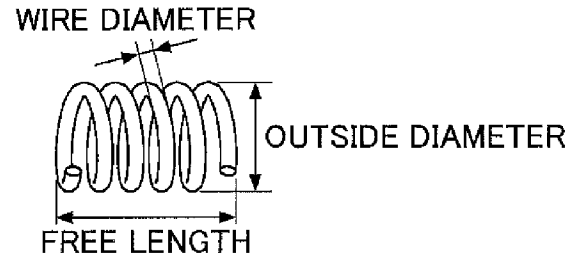

EXAMPLE 1
WIRE DIAMETER : 0.9 mm
OUTSIDE DIAMETER : 12 mm
FREE LENGTH : 17 mm
SPRING CONSTANT: 1.37 N/mm

EXAMPLE 2
WIRE DIAMETER: 0.29 mm
OUTSIDE DIAMETER : 3.5 mm
FREE LENGTH : 6.5 mm
SPRING CONSTANT: 0.46 N/mm

EXAMPLE 3
WIRE DIAMETER: 0.32 mm
OUTSIDE DIAMETER : 3.2 mm
FREE LENGTH : 14 mm
SPRING CONSTANT: 0.33 N/mm

EXAMPLE 4
WIRE DIAMETER: 0.35 mm
OUTSIDE DIAMETER: 6 mm
FREE LENGTH : 14 mm
SPRING CONSTANT: 0.14 N/mm

FIG.19
(A)
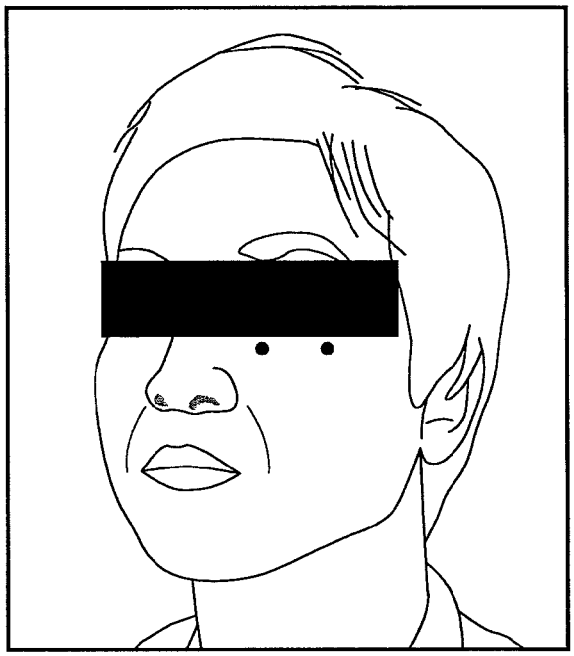
(B)
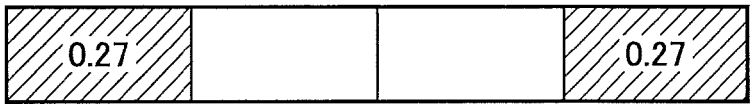

FIG.20
(A)
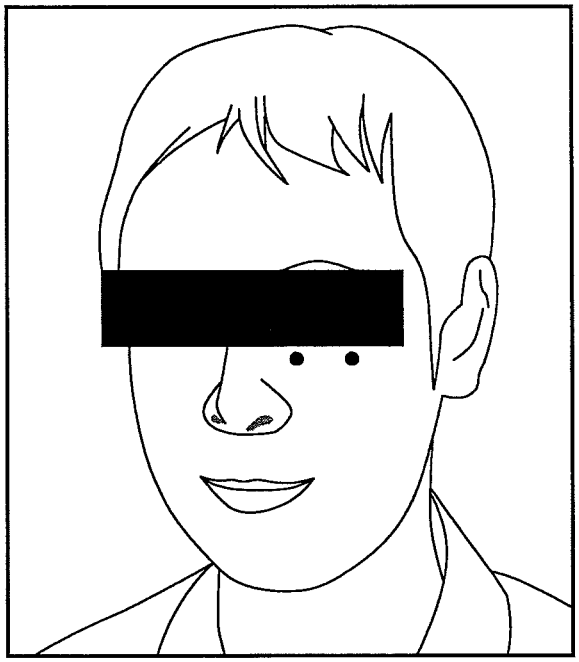
(B)
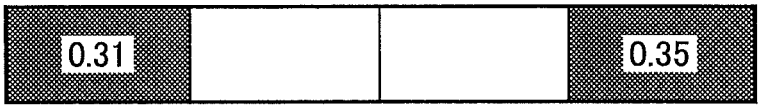

FIG.21
(A)
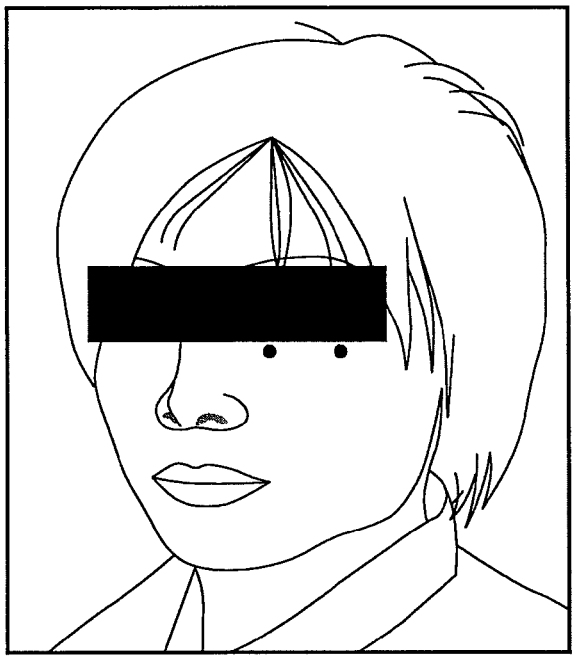
(B)
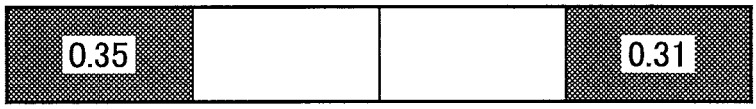

FIG.22
(A)
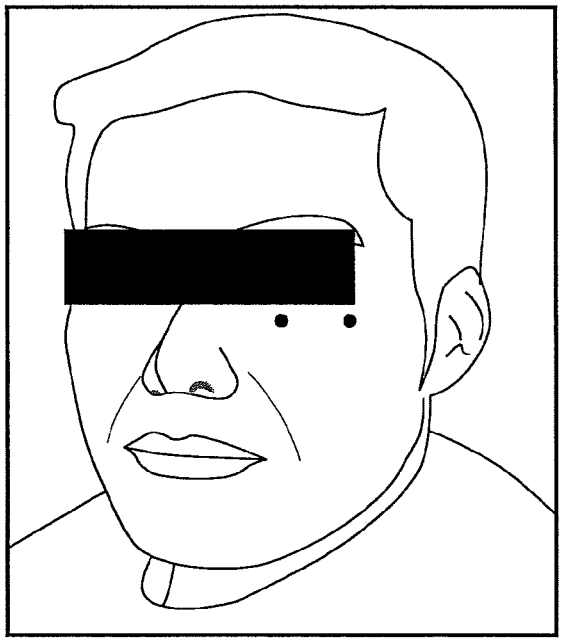
(B)
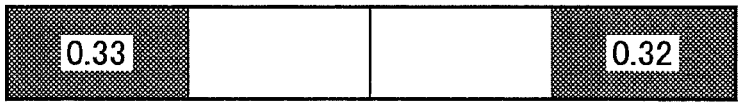

FIG.23
(A)
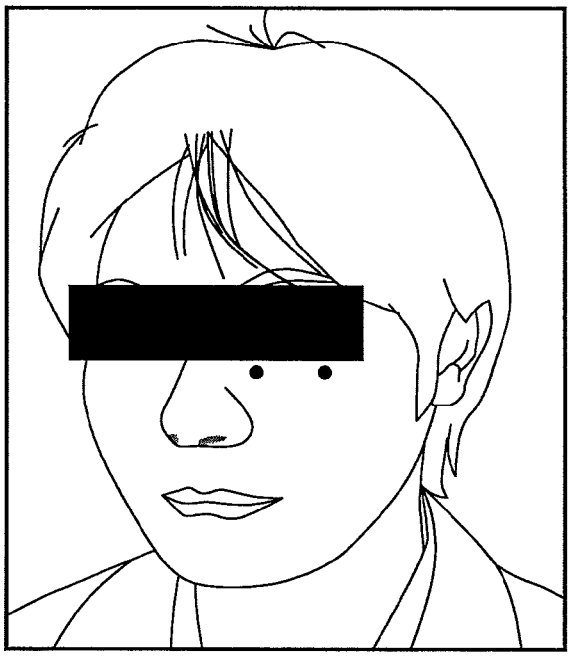
(B)
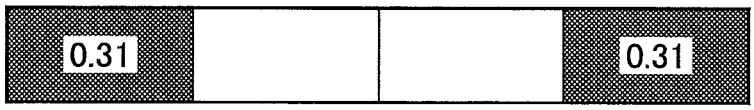

FIG.24
(A)
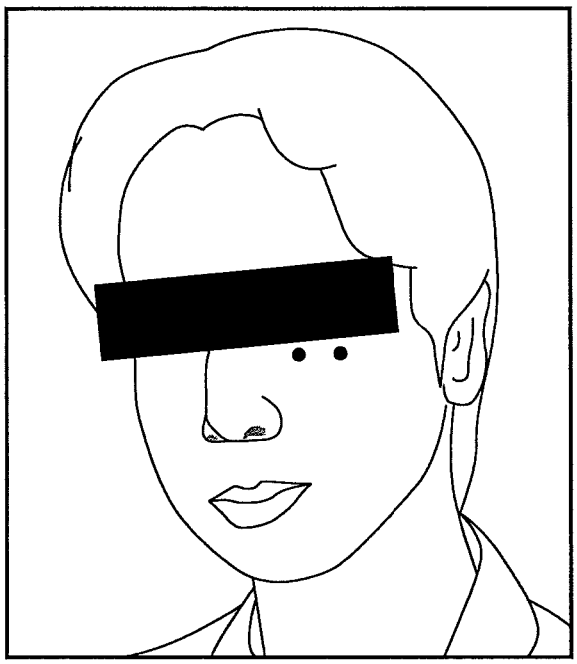
(B)
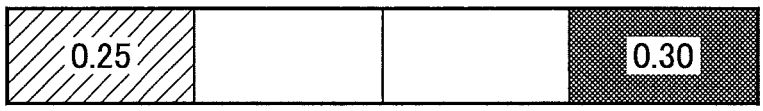

MASSAGING DEVICE

TECHNICAL FIELD

The present invention generally relates to a massaging device. More particularly, the present invention relates to a massaging device that massages parts of the body to be treated with vibrators pressed against the part of the body.

BACKGROUND ART

There exist massaging devices for relieving stiffness in the shoulders, the back, and the legs. Also, acupressure or massage of pressure points on a face has been practiced as a method of facial treatment. Generally, a massager or a patient him/herself presses or vibrates pressure points or stiff parts of the body (hereafter referred to as "target parts") with fingers to massage the target parts. Massage improves the flow of the blood and the metabolism at the target parts, and thereby improves symptoms at the target parts.

However, it is not possible to press a large number of pressure points at the same time using the fingers of the massager or the patient. Also, acupressure with human fingers involves a heavy workload by the massager or the patient. To solve these problems, massaging devices with plural vibrators have been proposed (see patent documents 1 and 2). The proposed massaging devices can massage multiple target parts at the same time. Therefore, compared with the method of applying acupressure with fingers, the proposed massaging devices make it possible to reduce the workload of a massager or a patient.

RELATED-ART DOCUMENTS

Patent Documents

[Patent document 1] Japanese Laid-Open Patent Publication No. 2001-000503

[Patent document 2] Japanese Laid-Open Patent Publication No. 2001-346845

DISCLOSURE OF INVENTION

Problems to be Solved by the Invention

However, although the related-art massaging devices can adjust the intensity of the vibration of vibrators, they cannot change the pressing forces applied by the vibrators to target parts. For example, the massaging device disclosed in patent document 1 includes protrusions that protrude toward target parts. Since the protrusions have the same length, pressing forces applied by the protrusions to target parts are substantially the same regardless of the physical characteristics of skin of the user at the target parts. Accordingly, the disclosed massaging device massages target parts with the same pressing force.

The massaging device disclosed in patent document 2 includes plural vibrating protrusions attached to helical compression springs and arranged in a housing, and the helical compression springs have the same spring constant. When the massaging device is pressed against target parts, the helical compression springs deform according to the shapes of the target parts. This configuration makes it possible to reliably press all the vibrating protrusions to the target parts. Still, however, since the helical compression springs have the same spring constant, pressing forces applied by the vibrating protrusions to target parts are substantially the same regardless of the physical characteristics of skin at the target parts.

Meanwhile, the physical characteristics of skin vary from one part of the body of a person to another part. Therefore, when target parts with different physical characteristics of skin are massaged with the same pressing force, the massage may be effective in some target parts but may be less effective in other target parts. Thus, with the related-art configuration, desired massage effects may not be obtained. Also with the related-art configuration, the user may feel that the intensity of massage is high in some target parts and low in other target parts, and may feel that the massaging device is unsatisfactory.

One object of the present invention is to solve or reduce one or more of the above problems and to provide a massaging device that has good usability and reliably provides desired massage effects.

Means for Solving the Problems

In an aspect of the embodiments of the present invention, there is provided a massaging device that includes a base part, vibrators configured to be brought into contact with target parts of a user and to massage the target parts with vibration, and springs each including a first end fixed to the base part and a second end attached to the corresponding one of the vibrators. The spring constants of the springs are set based on skin stress of the target parts.

Advantageous Effect of the Invention

Embodiments of the present invention provide a massaging device that can improve massage effects by massaging target parts according to skin stresses of the target parts.

BRIEF DESCRIPTION OF THE DRAWINGS

Other objects, features and advantages of the present invention will become more apparent from the following detailed description when read in conjunction with the accompanying drawings.

FIG. 15 is a drawing illustrating a relationship between the spring constant of a coil spring and skin stress;

FIG. 19 is a drawing illustrating exemplary results of measuring skin stress in an under-eye area (1);

FIG. 20 is a drawing illustrating exemplary results of measuring skin stress in an under-eye area (2);

FIG. 21 is a drawing illustrating exemplary results of measuring skin stress in an under-eye area (3) ;

FIG. 22 is a drawing illustrating exemplary results of measuring skin stress in an under-eye area (4);

FIG. 23 is a drawing illustrating exemplary results of measuring skin stress in an under-eye area (5); and FIG. 24 is a drawing illustrating exemplary results of measuring skin stress in an under-eye area (6).

BEST MODE FOR CARRYING OUT THE INVENTION

Embodiments of the present invention are described below with reference to FIGS. 1 through 24.

Figure 1:
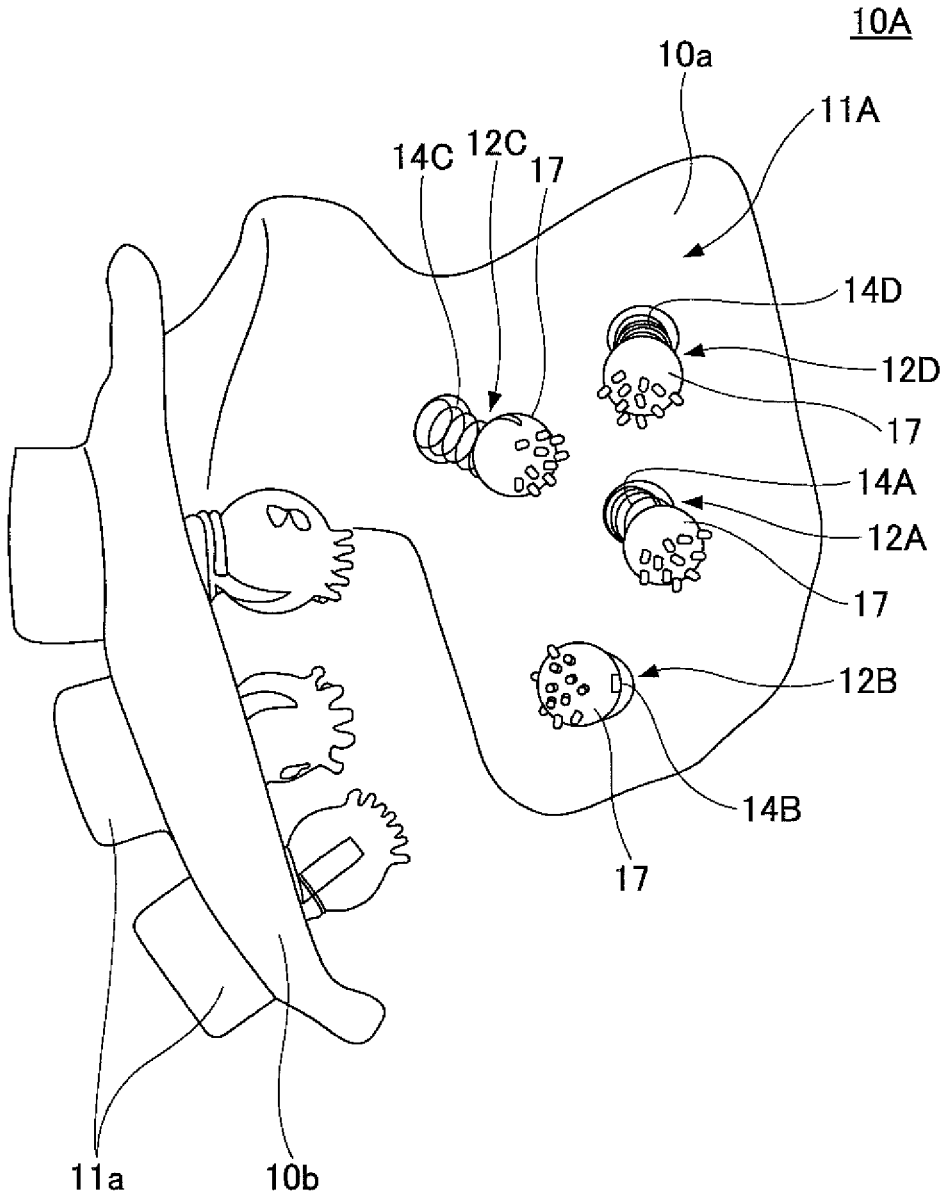
FIG. 1 is a perspective view of a massaging device according to a first embodiment of the present invention.
Figure 2:
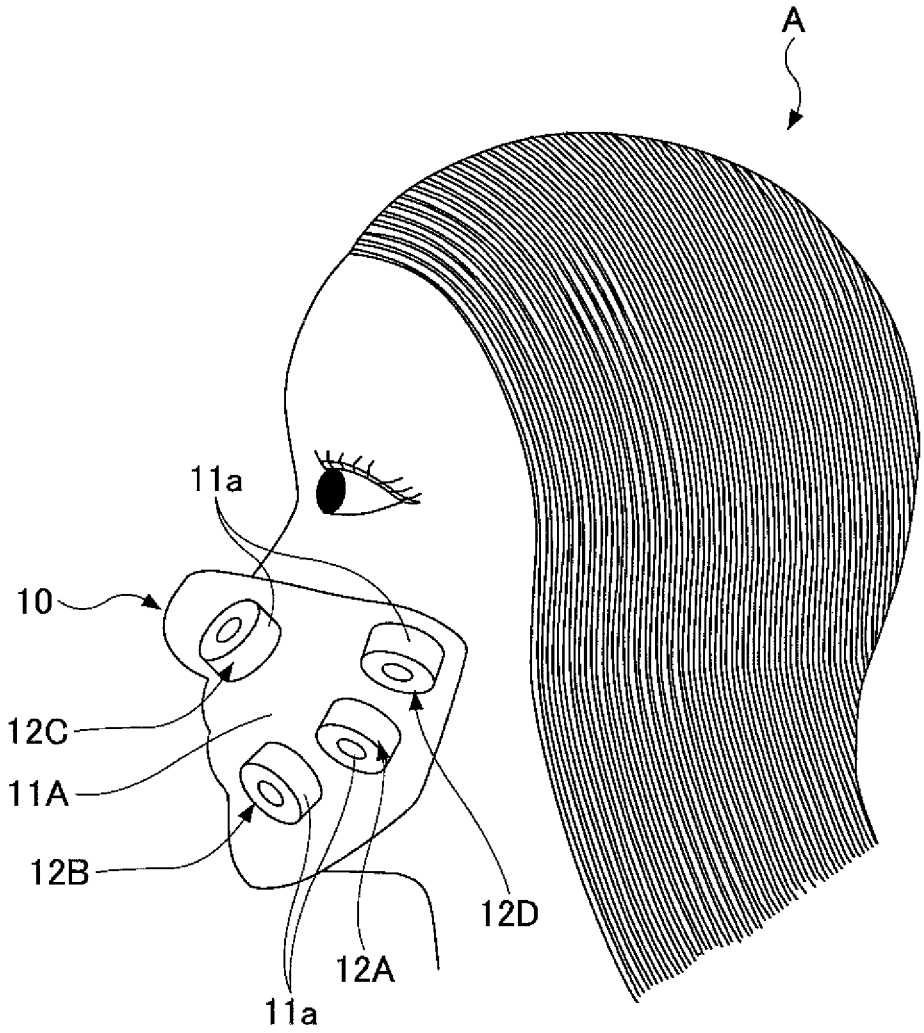
FIG. 2 is side view of a massage mask being worn according to the first embodiment of the present invention.
Figure 3:
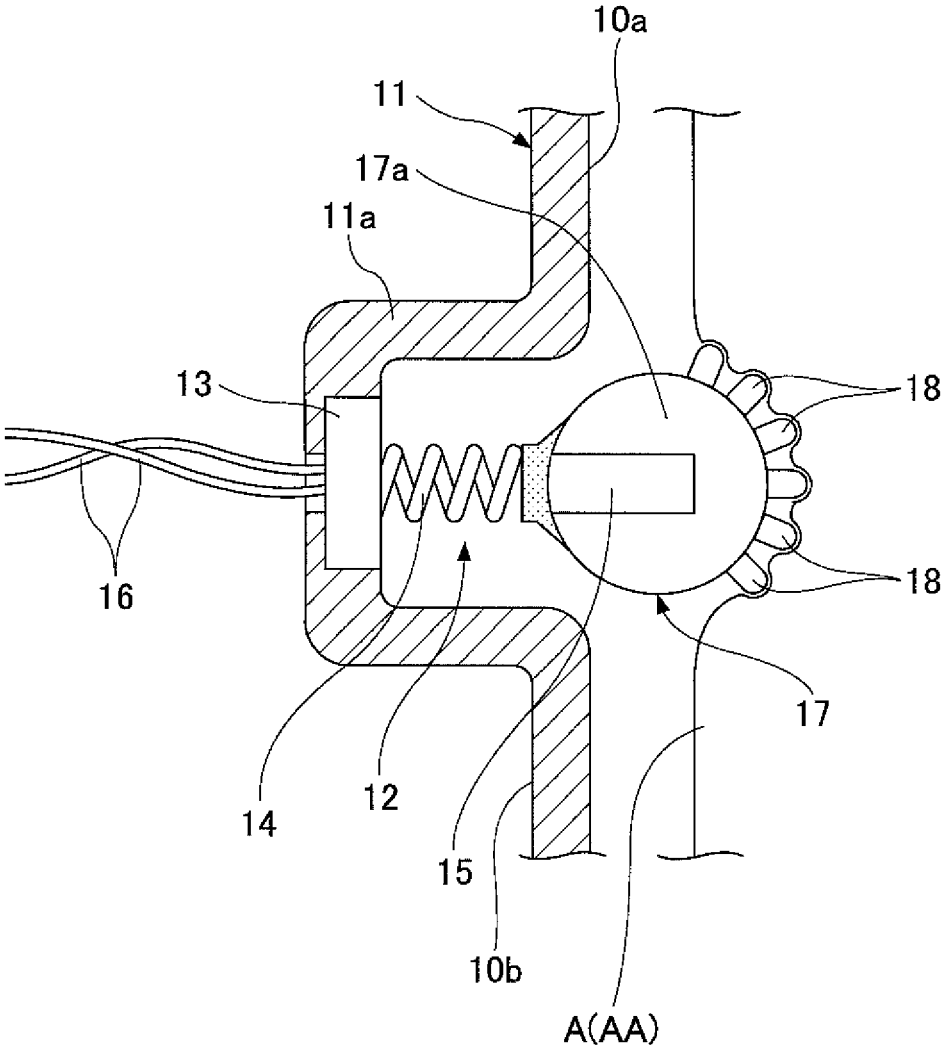
FIG. 3 is an enlarged view of a vibrator being in contact with the skin of a wearer.
Figure 4:
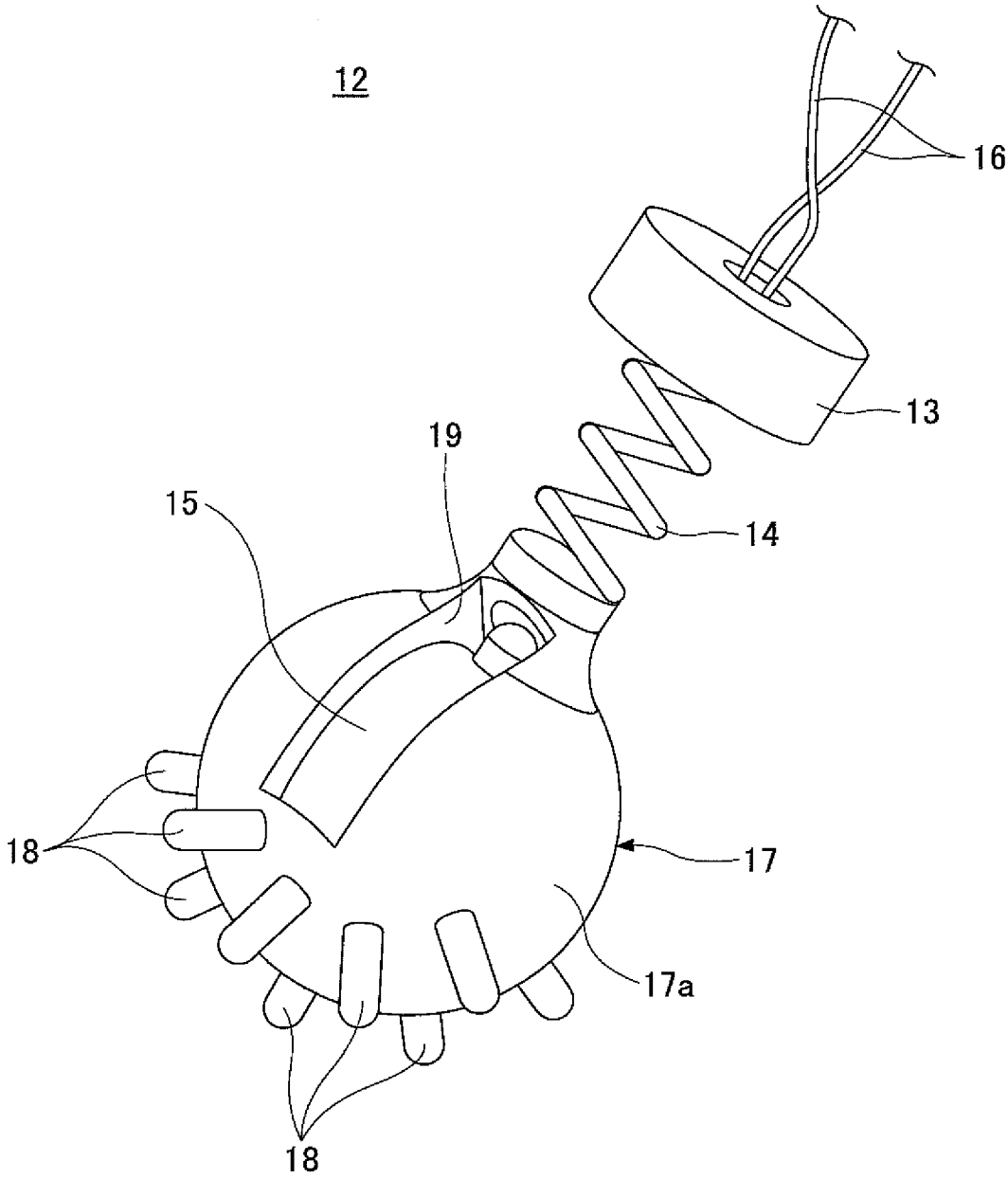
FIG. 4 is an enlarged perspective view of a vibrator of a massage mask according to the first embodiment of the present invention.
Figure 5:
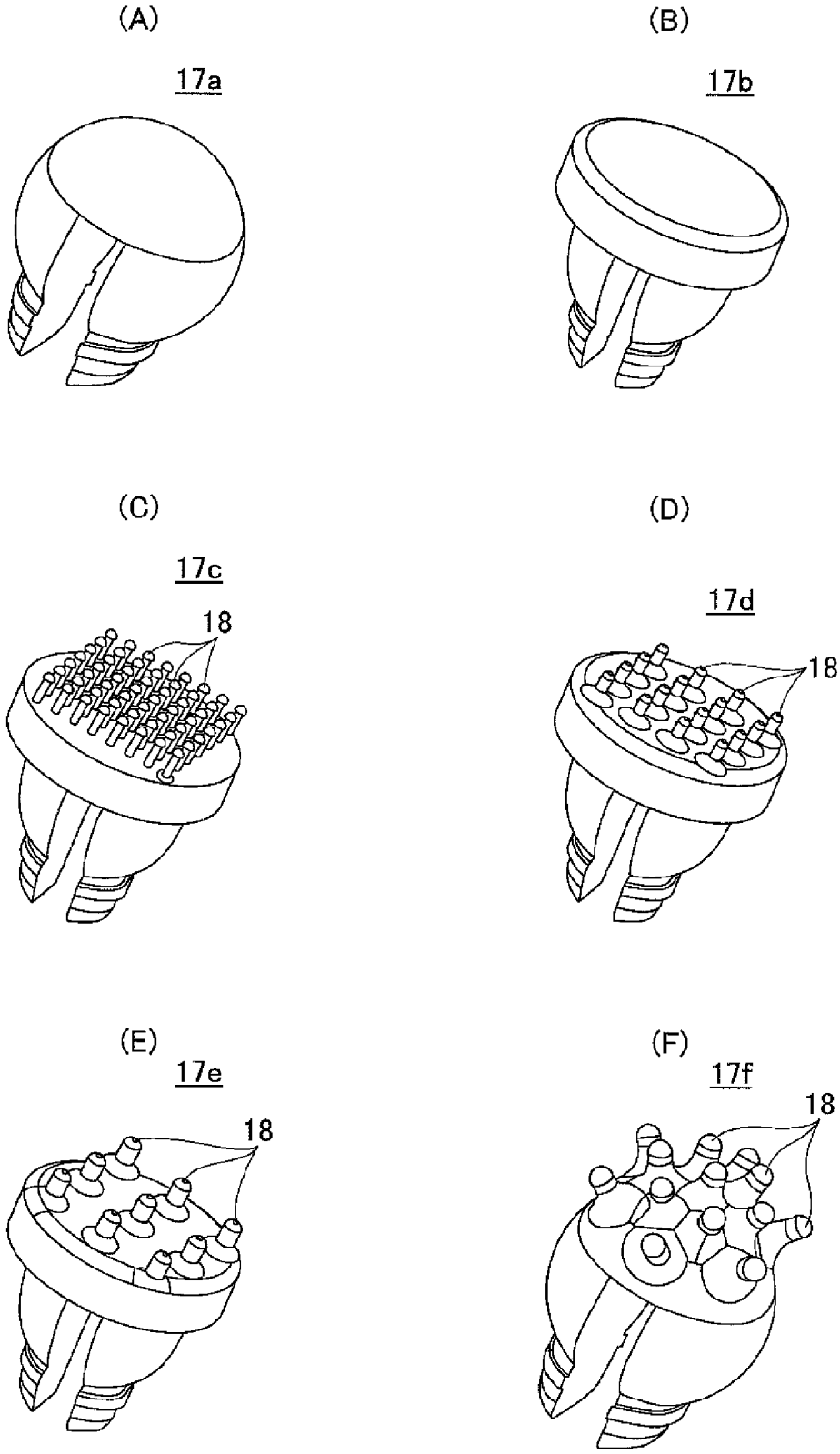
FIG. 5 is a drawing illustrating exemplary configurations of a contact part.

FIGS. 1 through 4 are drawings used to describe a massaging device 10A according to a first embodiment of the present invention. FIG. 1 is a perspective view of the massaging device 10A, FIG. 2 is a side view of the massaging device 10A being worn, FIG. 3 is an enlarged view of a contact part 17 being in contact with a skin AA, and FIG. 4 is an enlarged perspective view of a vibrator 12.

The massaging device 10A includes a base part 11A and vibrators 12A through 12D (may be collectively referred to as the vibrator(s) 12). As illustrated in FIG. 2, the massaging device 10A of the present embodiment is worn on the face of a user A.

Two sets of the vibrators 12A through 12D are symmetrically arranged with respect to the center (corresponding to the position of the nose of the user A wearing the massaging device 10A) of the base part 11A. For brevity and clarity, one set of the vibrators 12A through 12D on one side (right side in the figures) are described below.

The base part 11A is composed of a resin such as acrylonitrile butadiene styrene (ABS), polycarbonate (PC), or polypropylene (PP). The massaging device 10A is shaped such that an inner surface 10*a* of the base part 11A has a shape corresponding the shape of the face of the user A. Breathing holes may be formed in the base part 11A at positions corresponding to the nose and mouth of the user A so that the user A does not have difficulty in breathing when wearing the massaging device 10A.

As illustrated in FIGS. 3 and 4, plural vibrators 12 (vibrators 12A through 12D) are provided on the inner surface 10*a* of the massaging device 10A. Contact parts 17 of the vibrators 12 vibrate to massage target parts (e.g., pressure points on the face). The vibrators 12 massage target parts of the face of the user A with vibration to improve the flow of the blood and the metabolism of the user A.

Each of the vibrators 12 includes a fixed part 13, a coil spring 14 (one of coil springs 14A-14D), a vibrating motor 15, and a contact part 17. The fixed part 13 is composed of a resin and fixed to the base part 11A. Mounting parts 11*a*, which are recesses shaped like a cylinder with a bottom, are formed in the base part 11A at positions where the vibrators 12 are mounted. The fixed part 13 is fixed to the bottom of the mounting part 11*a* (see FIG. 3). Thus, the vibrators 12 are fixed to the base part 11A.

The coil spring 14 is formed by winding wire made of a spring material like a coil. In the present embodiment, the coil spring 14 is used as an example of a spring provided between the fixed part 13 and the contact part 17. Any other type of spring whose spring constant is variable and that is capable of pressing the contact part 17 against the skin AA may be used in place of the coil spring 14.

One end of the coil spring 14 facing the base part 11A is fixed to the fixed part 13, and the contact part 17 is attached to the other end of the coil spring 14. According to the present embodiment, the spring constants of the coil springs 14A through 14D of the vibrators 12A through 12D are determined according to the skin stress of parts of the skin AA with which the vibrators 12A through 12D (i.e., the contact parts 17) are brought into contact. Details of the spring constants are described later.

The contact part 17 includes a spherical body and plural protrusions 18 formed on the body. When the user A wears the massaging device 10A, the contact part (i.e., the protrusions 18) is brought into contact with the skin of the user A. A mounting groove 19 is formed in a side of the contact part 17. The vibrating motor 15 is mounted in the mounting groove 19. The vibrating motor 15 is shaped like a small disc and includes an eccentric rotor. The vibrating motor 15 generates vibration by rotating the rotor. Accordingly, when the vibrating motor 15 is driven, the contact part 17 vibrates, and the vibration is magnified by the coil spring 14.

The vibrators 12 are disposed such that the contact parts 17 contact target parts that the user A desires. It is generally said that there are 30 or more pressure points on the face, and the massage effects vary depending on the positions of the pressure points. For this reason, the vibrators 12 are disposed at positions on the skin (i.e., target parts) where therapeutic effects desired by the user A are obtained.

Here, a relationship between pressure stimulation conditions and the amount of nitric oxide (NO) production, which is a vasodilator, is briefly described based on the findings of the inventors of the present invention (see Japanese Laid-Open Patent Publication No. 2009-204452).

The inventors conducted experiments to find out the relationship between pressure stimulation conditions and the amount of nitric oxide (NO) production. More specifically, experiments (a) through (d) below were performed by varying pressure stimulation conditions applied to the skin:

(a) The number of pressing points on the skin was varied.

(b) The temperature applied to the skin was varied.

(c) The speed of applying stimuli to the skin was varied.

(d) The weight applied to the skin was varied.

The experiments (a) through (d) were conducted under experimental conditions as described below. A hairless mouse at the age of 10 to 13 weeks old was anesthetized by injecting 4 ml/kg of a 25% solution of carbonic acid ethyl ester into its abdominal cavity, a skin of the back of the hairless mouse was sampled, and the hairless mouse was euthanized. Then, muscle layers and blood vessels were removed from the sampled skin to obtain a skin tissue with a size of 1.5 cm×15 cm.

The skin tissue was placed on a Teflon (registered trademark) mesh, floated in a culture dish containing 2 mL of MCDB153 culture medium (Sigma), and cultured for two hours using a CO2 incubator (37° C., 5% CO2, humidity 95%). Next, the culture medium was replaced with a balanced salt solution (BSS) with an additive of 10 μM of DAF-2 (Daiichi Pure Chemicals Co., Ltd.), and the skin tissue was cultured further for one hour.

Here, the BSS includes NaCl (150 mM), KCl (5 mM), CaCl2 (1.8 mM), MgCl2 (1.2 mM), HEPES (25 mM), NaH2PO4 (1.2 mM), and D-glucose (10 mM), and has a pH of 7.4. Then, 400 μL of the resulting culture solution was collected and centrifuged, and the supernatant was collected as a sample before stimulation.

A polyurethane rubber sheet was placed on the horny layer of the cultured skin tissue, and the cultured skin tissue was stimulated by pressing from above the polyurethane rubber sheet using a cylindrical weight (diameter: 2 cm, height: 2 cm, weight: 53 g) under predetermined conditions described later. Also, for comparison, the skin tissue was kept in CO2 incubator (37° C., 5% CO2, humidity 95%) for 10 minutes without stimulation (no stimulation). Then, 400 μL of the resulting culture solution was collected and centrifuged, and the supernatant was collected as a sample after stimulation. The obtained samples before and after stimulation were incubated for one hour at an ambient temperature (23° C.), moved to a 96-hole plate for fluorescence measurement, and the fluorescence was measured using a microplate reader.

Results of the experiment (a) performed under the above experimental conditions are described below. In the experiment (a), weights with different numbers of protrusions, i.e., pressing points, were used. The numbers of pressing points of the used weights were 4.5, 12.5, 30, and 81 $cm^{-2}$. According to the results, the amount of NO production increases as the number of pressing points increases. Thus, the results indicate that it is possible to increase vasodilation and thereby improve the massage effects by increasing the number of pressing points.

Next, results of the experiment (b) performed under the above experimental conditions are described. In the experiment (b), the environmental temperature during application of stimulation was set at 37° C., 33° C., and 23° C. (room temperature). According to the results, the amount of NO production at the environmental temperatures of 33 ° C. and 37° C. is greater than the amount of NO production at the environmental temperature of 23° C. (room temperature). Thus, the results indicate that it is possible to increase vasodilation and thereby improve the massage effects by increasing the environmental temperature at which stimulation is applied (i.e., massage is performed).

Next, results of the experiment (c) performed under the above experimental conditions are described. In the experiment (c), the speed of rolling the weight used to apply stimuli was set at 8.5 round-trips per minute, 23.5 round-trips per minute, and 38.5 round-trips per minute. According to the results, the amount of NO production at the speed of 23.5 round-trips per minute is greater than the amount of NO production at the speed of 8.5 round-trips per minute. Also, the amount of NO production at the speed of 38.5 round-trips per minute is greater than the amount of NO production at the speed of 8.5 round-trips per minute. Thus, the results indicate that it is possible to increase vasodilation and thereby improve the massage effects by increasing the speed of applying stimuli.

Next, results of the experiment (d) performed under the above experimental conditions are described. In the experiment (d), a weight of 53 g and a weight of 17 g were used to apply stimuli. According to the results, the amount of NO production with the weight of 17 g is greater than the amount of NO production in a case where no stimulus is applied; and the amount of NO production with the weight of 53 g is greater than the amount of NO production with the weight of 17 g. Thus, the results indicate that it is possible to increase vasodilation and thereby improve the massage effects by increasing the weight (i.e., the strength of massaging force) applied to the skin.

After the experiments, the inventors considered how the experimental results can be applied to a massaging device.

The results of the experiment (a) can be applied to the contact part 17 of the vibrator 12 of the massaging device 10A. A simple spherical shape as illustrated by a contact part 17*a* of FIG. 5 (A) or a planar shape as illustrated by a contact part 17*b* of FIG. 5(B) may be used for the contact part 17. However, with the spherical contact part 17*a* or the planar contact part 17*b*, since the number of pressing points on the skin is small, it is difficult to increase vasodilation (and to improve the massage effects).

Meanwhile, with contact parts 17*c* through 17*e* of FIGS. 5(C) through (E) having plural protrusions 18 on a planar body and a contact part 17*f* of FIG. 5(F) having plural protrusions 18 on a spherical body, since the number of pressing points at which the contact parts 17*c* through 17*f* contact the skin AA is large, it is possible to increase vasodilation and thereby improve the massage effects.

The results of the experiment (b) can also be applied to a massaging device. For example, a heater may be provided in the contact part 17. The results of the experiment (c) can also be applied to a massaging device. For example, the intensity of vibration generated by the vibration motor 15 may be adjusted by controlling the voltage applied to the vibration motor 15.

The results of the experiment (d) can be applied to the coil spring 14 of the vibrator 12 of the massaging device 10A. For example, it may be possible to press the vibrating contact part 17 (that stimulates the skin AA) strongly against the skin AA by increasing the spring constant of the coil spring 14, and to thereby increase vasodilation (i.e., improve the massage effects).

However, according to experiments conducted by the inventors, it is difficult to effectively increase vasodilation (i.e., improve the massage effects) by uniformly increasing the spring constants of the coil springs 14 of plural vibrators 12 provided on the base part 11A.

Figure 6:
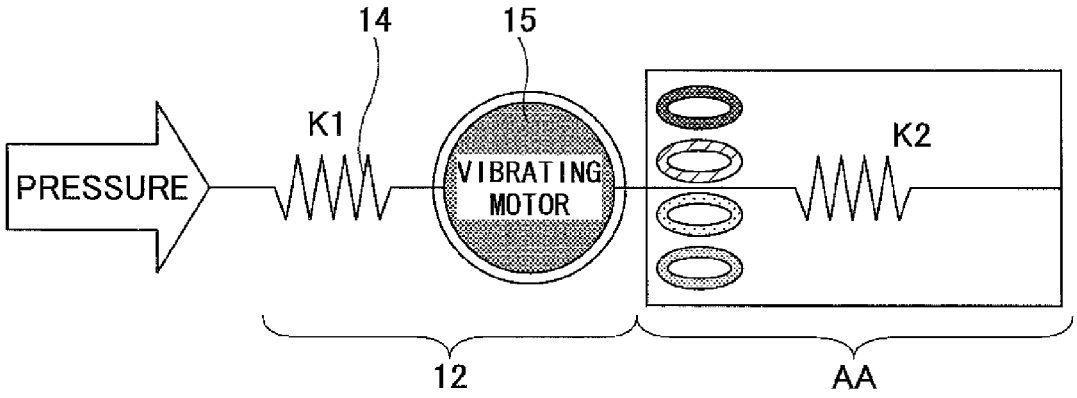
FIG. 6 is a model diagram where a vibrator and skin are represented as elastic bodies.

The reasons why it is difficult to increase vasodilation are described below with reference to FIG. 6. FIG. 6 is a model diagram where the vibrator 12 and the skin AA are represented as elastic bodies. Taking, for example, the face of the user A, the skin AA includes dermis and epidermis stacked on a skeleton. The dermis and the epidermis can be elastically deformed, and therefore they can be considered to be equivalent to a type of spring having a spring constant (K2). In the model diagram of FIG. 6, the coil spring 14 with a spring constant K1 is connected to one end of the vibrating motor 15 (the contact part 17) and a spring (with the spring constant K2) representing the skin AA is connected to the other end of the vibrating motor 15.

Also in the model diagram of FIG. 6, it is assumed that the spring constant K2 of the skin AA is fixed, and the spring constant K1 of the coil spring 14 is variable. FIG. 7(A) illustrates a case where the spring constant K1 of the coil spring 14 is greater than the spring constant K2 of the skin AA (K1>K2).

When the spring constant K1 of the coil spring 14 is greater than the spring constant K2 of the skin AA (K1>K2), the vibrating motor 15 is pressed strongly against the skin AA. In this case, the vibration generated by the vibrating motor 15 is transmitted to the skin AA without being attenuated by the coil spring 14, and therefore applied even to the deep layer of the skin AA. Thus, with K1>K2, the vibration of the vibrating motor 15 acts even on the deep layer of the skin AA. This in turn makes it possible to increase vasodilation and improve the massage effects.

FIG. 7(B) illustrates a case where the spring constant K1 of the coil spring 14 is less than the spring constant K2 of the skin AA (K1<K2). In this case, the vibrating motor 15 is pressed against the skin AA with a small force. Since the spring constant K1 of the coil spring 14 is smaller than the spring constant K2, the vibration generated by the vibrating motor 15 is attenuated by the coil spring 14 and a small fraction of the vibration is transmitted to the skin AA. For this reason, the vibration of the vibrating motor 15 acts only on the surface layer of the skin AA and does not act on the deep layer of the skin AA. Accordingly, in this case, it may be difficult to increase vasodilation in the deep layer of the skin AA.

However, in recent studies (Journal of Investigative Dermatology, 2009, Ikeyama et al.), it has been found out that a vasodilator (NO) is produced by epidermis of skin when pressure stimulation is applied to the epidermis, and blood vessels and lymphatics in dermis are dilated by the produced vasodilator. According to this finding, it may be possible to increase esthetic effects (e.g., improve the flow of blood) by setting the spring constant K1 of the coil spring 14 at a value less than the spring constant K2 of the skin AA.

In the above descriptions, it is assumed that the spring constant K2 of the skin AA is fixed. However, different parts of the skin AA of the user A may be in different conditions and may have different physical characteristics (including spring constants). For this reason, the inventors measured the physical characteristics of the skin AA of the user A using the massaging device 10A, and tried to determine the spring constant K1 of the coil spring 14 based on the measurement results.

Figure 7:
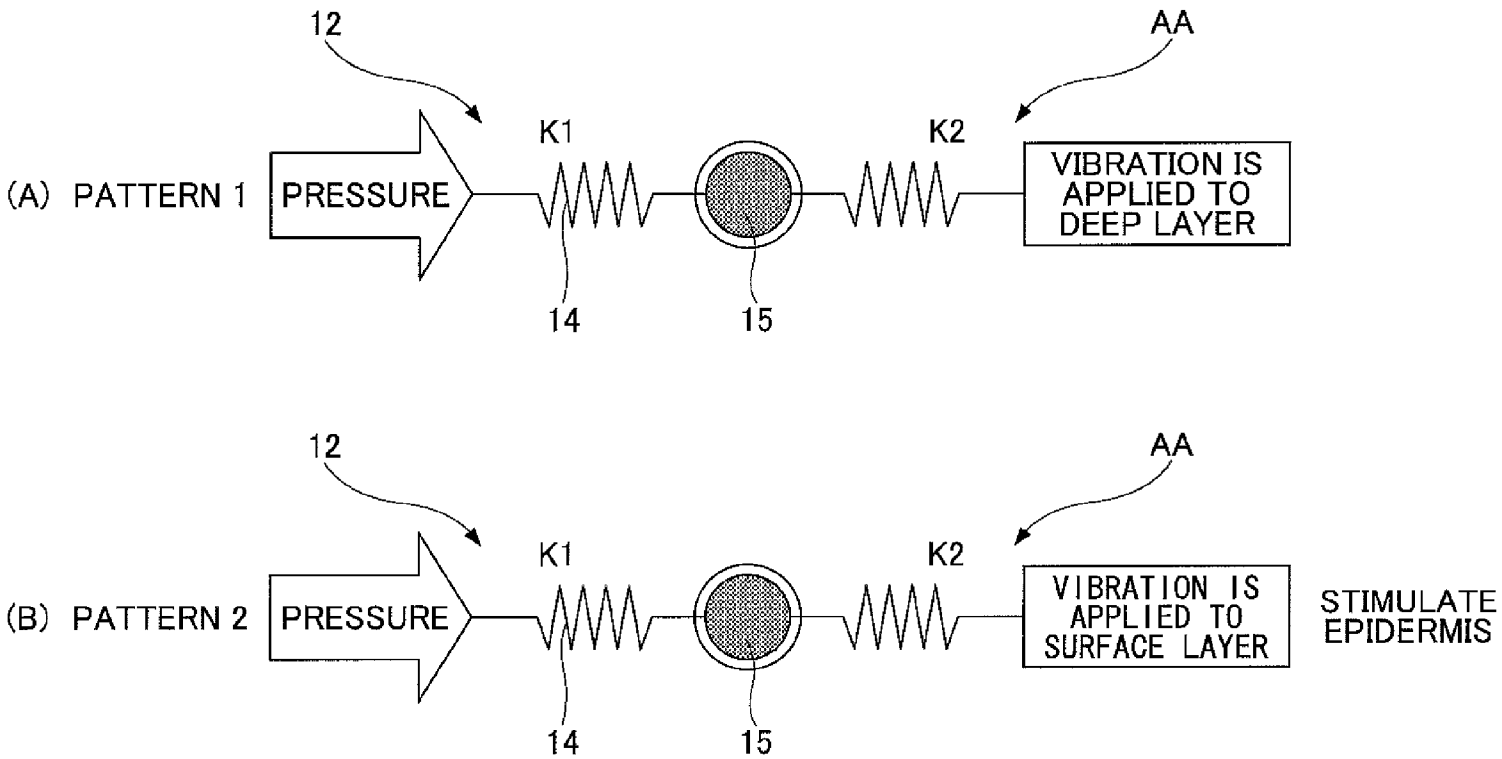
FIG. 7 is a drawing used to describe selection of a spring constant for massaging dermis and a spring constant for massaging epidermis.
Figure 8:
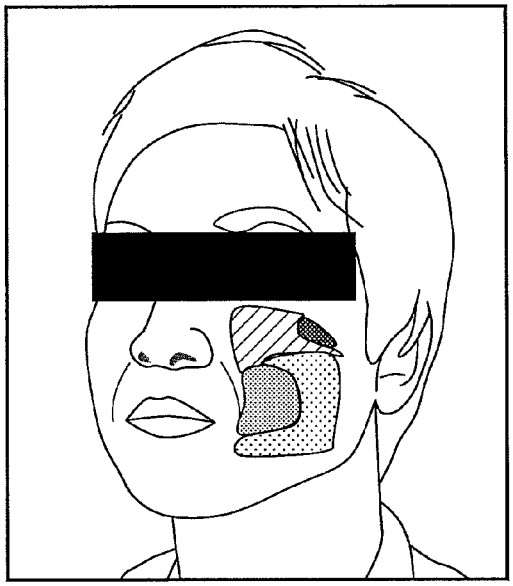
FIG. 8 is a drawing illustrating exemplary results of measuring skin stress in an area corresponding to a cheek (1)
Figure 9:
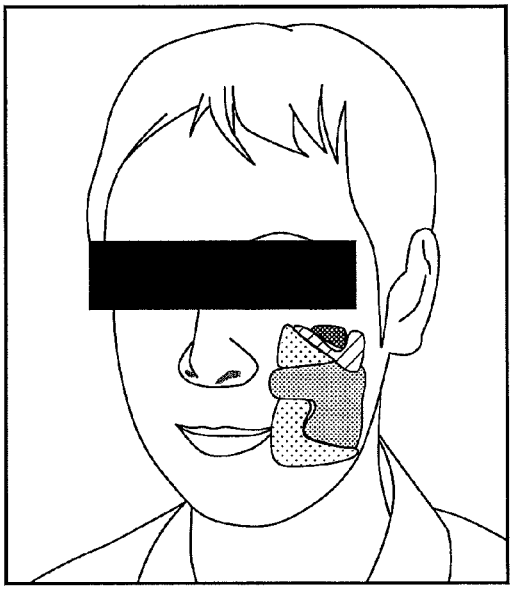
FIG. 9 is a drawing illustrating exemplary results of measuring skin stress in an area corresponding to a cheek (2)
Figure 10:
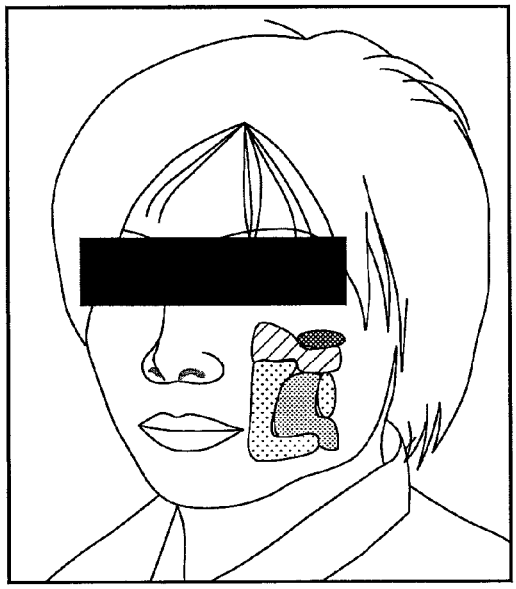
FIG. 10 is a drawing illustrating exemplary results of measuring skin stress in an area corresponding to a cheek (3)
Figure 11:
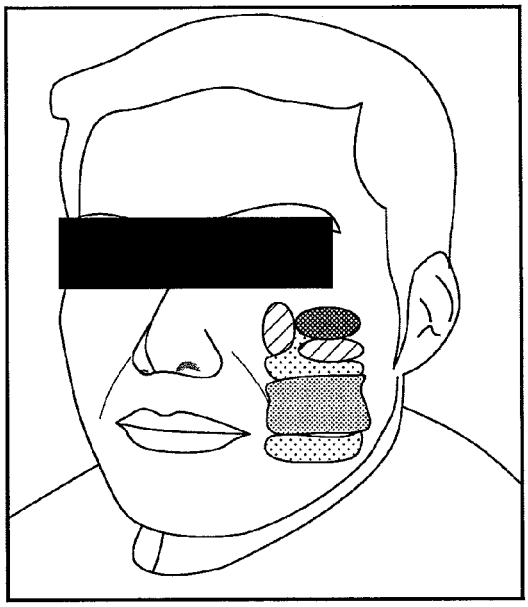
FIG. 11 is a drawing illustrating exemplary results of measuring skin stress in an area corresponding to a cheek (4)
Figure 12:
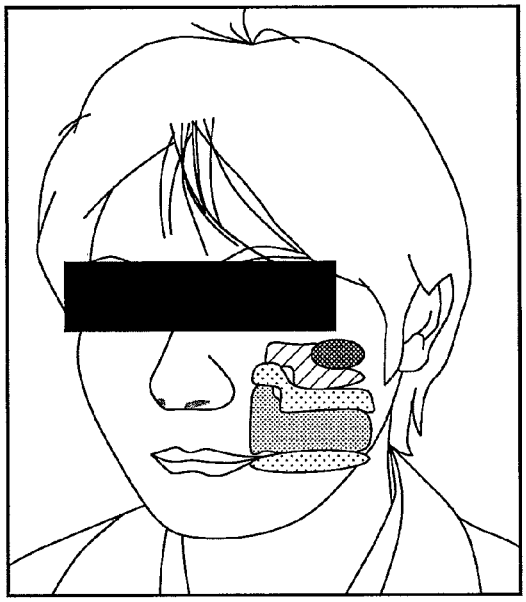
FIG. 12 is a drawing illustrating exemplary results of measuring skin stress in an area corresponding to a cheek (5)
Figure 13:
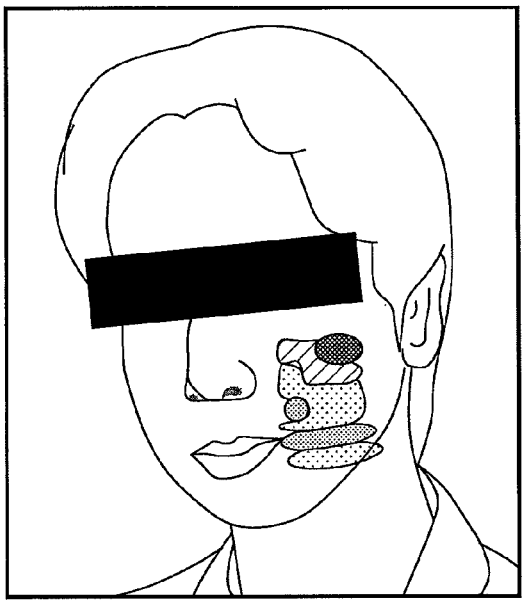
FIG. 13 is a drawing illustrating exemplary results of measuring skin stress in an area corresponding to a cheek (6)

According to the model diagrams of FIGS. 6 and 7, it is preferable to directly measure the spring constant K2 of the skin AA of the user A. In practice, however, it is difficult to directly measure the spring constant K2 of the skin AA of the user A. Therefore, the inventors decided to measure the stress of the skin AA (hereafter referred to as "skin stress") and determine the spring constant K1 of the coil spring 14 based on the measured skin stress. In the present embodiment, the skin stress is defined as stress obtained when the skin is pressed 10 mm per second.

Generally, the skin stress of a soft part of the skin AA is small and therefore its spring constant K2 is small. Meanwhile, the skin stress of a hard part of the skin AA is large and therefore its spring constant K2 is large. Thus, since there is a correlation between the skin stress of the skin AA and the spring constant K2 of the skin AA, it is possible to determine the spring constant K1 of the coil spring 14 based on the skin stress of the skin AA.

The massaging device 10A of the present embodiment is worn on the face of the user A to massage the face. Therefore, the inventors conducted an experiment to measure the skin stress of the faces of experimental subjects illustrated in FIG. 8(A) through FIG. 13(A). In the experiment to measure the skin stress, 7×4=28 measurement positions were defined in an area (which roughly corresponds to a cheek) of the face surrounded by the eye, the nose, the mouse, and the ear, and the skin stress was measured by pressing a force gauge against the face at the respective measurement positions. More specifically, the skin stress was measured at each of the measurement positions by pressing the skin, 10 mm per second, with the force gauge.

The results are illustrated in FIGS. 8(B) through 13(B). Values in FIGS. 8(B) through 13(B) indicate measurements (g) obtained by the force gauge. The measurements are classified into four ranges: less than 0.1 g (soft), greater than or equal to 0.1 g and less than 0.2 g (relatively soft), greater than or equal to 0.2 g and less than 0.3 g (relatively hard), and greater than or equal to 0.3 g (hard). The ranges are indicated by shading.

On the faces of the experimental subjects illustrated in FIGS. 8(A) through 13(A), the distribution of measured skin stress (the measurements in FIGS. 8(B) through 13(B)) is indicated by the same shading as that used in FIGS. 8(B) through 13(B).

Figure 14:
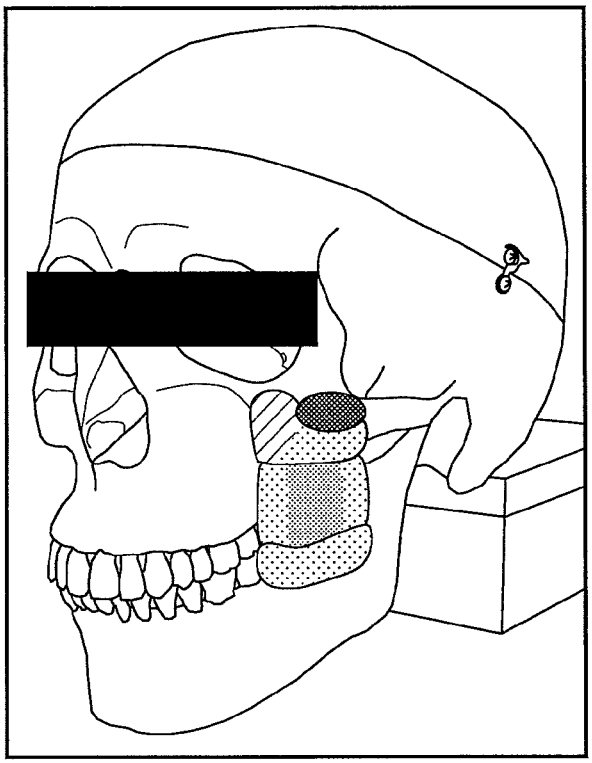
FIG. 14 is a drawing illustrating a relationship between a skull and skin stress.

The measurement results of the skin stress indicate that although there is some individual variation, the skin stress is roughly similar among the experimental subjects. In FIG. 14, the distribution of skin stress based on the average values of the above experimental results is indicated on a skull using the same shading as that used in FIGS. 8(B) through 13(B). As indicated by FIG. 14, an area between the lower jawbone and the upper jawbone is a "soft" area, an area on and near the lower jawbone is a "relatively soft" area, an area on and near the upper jawbone is a "relatively hard" area, and an area on and near the cheek bone is a "hard" area.

FIG. 15 illustrates a relationship between skin stress and the wire diameter of a coil spring, and a relationship between skin stress and the spring constant of a coil spring.

The inventors conducted an experiment to obtain the relationship between the skin stress and the wire diameter of a coil spring, as described below. The skin stress was measured as described above by pressing the force gauge against the face at the measurement positions. Coil springs having the same outside diameter and free length and having different wire diameters were prepared, and the stress generated when the coil springs were pressed was measured using a force gauge in a manner similar to the measurement of the skin stress. More specifically, each of the coil springs was pressed, 10 mm per second, with the force gauge, and the resulting stress was measured by the force gauge. In the experiment, the outside diameter of the coil springs was set at 10 mm, and the free length of the coil springs was set at 20 mm.

As described above, the measurements of skin stress are classified into four ranges: less than 0.1 g (soft), greater than or equal to 0.1 g and less than 0.2 g (relatively soft), greater than or equal to 0.2 g and less than 0.3 g (relatively hard), and greater than or equal to 0.3 g (hard). The measurements of the stress of the coil springs were also classified in association with the four ranges of the skin stress, and the relationship between the wire diameters of the coil springs and the stress was determined as illustrated in FIG. 15.

As illustrated in FIG. 15, a wire diameter less than 0.53 mm corresponds to skin stress less than 0.1 g (soft); a wire diameter greater than or equal to 0.53 mm and less than 0.65 mm corresponds to skin stress greater than or equal to 0.1 g and less than 0.2 g (relatively soft); a wire diameter greater than 0.65 mm and less than 0.75 mm corresponds to skin stress greater than or equal to 0.2 g and less than 0.3 g (relatively hard); and a wire diameter greater than or equal to 0.75 mm corresponds to skin stress greater than or equal to 0.3 g (hard).

In the above experiment to determine the relationship between the skin stress and the wire diameter, coil springs with the same outside diameter and free length were used. However, without generalization, the results of the experiment are difficult to use in selecting coil springs. For this reason, the inventors decided to also obtain the relationship between wire diameters and spring constants of coil springs. Since there is a known relationship between spring constants and wire diameters, it is possible to obtain spring constants from wire diameters based on the known relationship. In FIG. 15, spring constants obtained based on the known relationship are associated with the ranges of the skin stress.

As illustrated in FIG. 15, a spring constant less than 0.2 N/mm corresponds to skin stress less than 0.1 g (soft); a spring constant greater than or equal to 0.2 N/mm and less than 0.4 N/mm corresponds to skin stress greater than or equal to 0.1 g and less than 0.2 g (relatively soft); a spring constant greater than or equal to 0.4 N/mm and less than 1.0 N/mm corresponds to skin stress greater than or equal to 0.2 g and less than 0.3 g (relatively hard); and a spring constant greater than or equal to 1.0 N/mm corresponds to skin stress greater than or equal to 0.3 g (hard).

With the spring constants associated with the skin stress, it is possible to flexibly select coil springs with various wire diameters, outside diameters, and free lengths. For example, a coil spring of Example 1 in FIG. 15, which has a wire diameter of 0.9 mm, an outside diameter of 12 mm, and a free length of 17 mm, has a spring constant of 1.37 N/mm, and may be used for a hard area with skin stress greater than or equal to 0.3 g. A coil spring of Example 2 in FIG. 15, which has a wire diameter of 0.29 mm, an outside diameter of 3.5 mm, and a free length of 6.5 mm, has a spring constant of 0.46 N/mm, and may be used for a relatively hard area with skin stress greater than or equal to 0.2 g and less than 0.3 g.

A coil spring of Example 3 in FIG. 15, which has a wire diameter of 0.32 mm, an outside diameter of 3.2 mm, and a free length of 14.0 mm, has a spring constant of 0.33 N/mm, and may be used for a relatively soft area with skin stress greater than or equal to 0.1 g and less than 0.2 g. A coil spring of Example 4 in FIG. 15, which has a wire diameter of 0.35 mm, an outside diameter of 6.0 mm, and a free length of 14.0 mm, has a spring constant of 0.14 N/mm, and may be used for a soft area with skin stress less than 0.1 g.

A method of setting the wire diameters (or spring constants K2) of the vibrators 12A through 12D of the massaging device 10A is described below with reference to FIG. 16. In the descriptions below, it is assumed that the massaging device 10A is used to increase vasodilation and thereby improve the massage effects.

Figure 16:
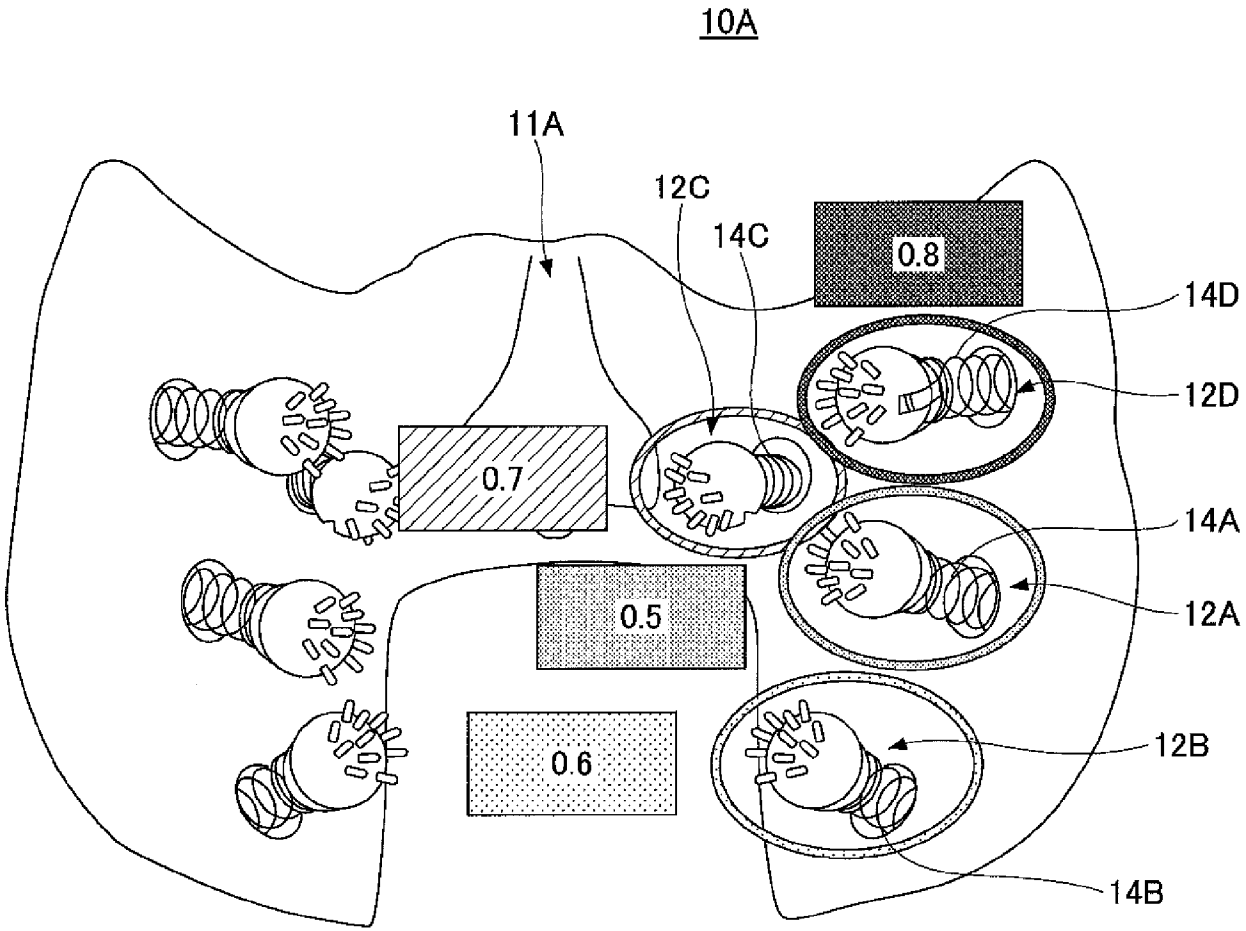
FIG. 16 is a drawing illustrating the inside of a massaging device according to the first embodiment of the present invention.

FIG. 16 is a drawing illustrating the inside of the massaging device 10A of the present embodiment. When the massaging device 10A is worn by the user A, the vibrator 12A contacts the skin AA of the user A at a position between the lower jawbone and the upper jawbone. In other words, the vibrator 12A is provided for a target part between the lower jawbone and the upper jawbone. The skin stress of the part of the skin AA between the lower jawbone and the upper jawbone is less than 0.1 g (soft). Therefore, according to FIG. 15, the coil spring 14A with a wire diameter less than 0.53 mm (in this embodiment, 0.5 mm) and a spring constant less than 0.2 N/mm is used for the vibrator 12A.

The vibrator 12B is provided for a target part on and near the lower jawbone. The skin stress of the part of the skin AA on and near the lower jawbone is greater than or equal to 0.1 g and less than 0.2 g (relatively soft). Therefore, according to FIG. 15, the coil spring 14B with a wire diameter greater than or equal to 0.53 mm and less than 0.65 mm (in this embodiment, 0.6 mm) and a spring constant greater than or equal to 0.2 N/mm and less than 0.4 N/mm is used for the vibrator 12B.

The vibrator 12C is provided for a target part on and near the upper jawbone. The skin stress of the part of the skin AA on and near the upper jawbone is greater than or equal to 0.2 g and less than 0.3 g (relatively hard). Therefore, according to FIG. 15, the coil spring 14C with a wire diameter greater than or equal to 0.65 mm and less than 0.75 mm (in this embodiment, 0.7 mm) and a spring constant greater than or equal to 0.4 N/mm and less than 1.0 N/mm is used for the vibrator 12C.

The vibrator 12D is provided for a target part on and near the cheek bone. The skin stress of the part of the skin AA on and near the cheek bone is greater than or equal to 0.3 g (hard). Therefore, according to FIG. 15, the coil spring 14D with a wire diameter greater than or equal to 0.75 mm (in this embodiment, 0.8 mm) and a spring constant greater than or equal to 1.0 N/mm is used for the vibrator 12D.

With the massaging device 10A where the wire diameters and the spring constants of the coil springs 14A through 140 are set as described above, the vibration of the vibrating motors 15 acts even on the deep layer of the skin AA at the target points corresponding to the vibrators 12A through 12D. Thus, the present embodiment makes it possible to increase vasodilation and improve the massage effects.

Figure 17:
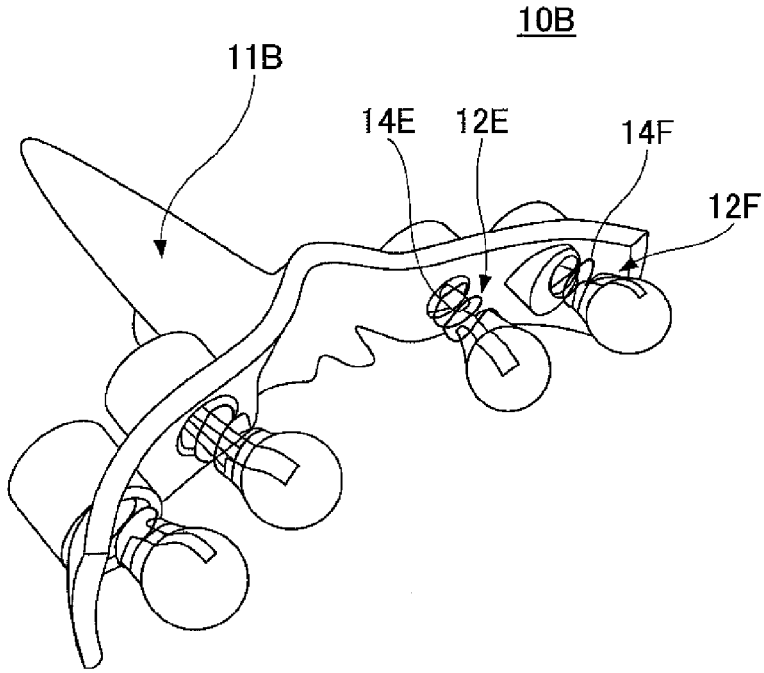
FIG. 17 is a perspective view of a massaging device according to a second embodiment of the present invention.

FIG. 17 illustrates a massaging device 10B according to a second embodiment of the present invention.

The massaging device 10A of the first embodiment is configured to mainly massage an area(s) on and near the cheek(s) of the user A. Meanwhile, the massaging device 10B of the second embodiment is configured to massage an area(s) (hereafter called an under-eye area EK) under an eye E of the user A illustrated in FIG. 18. Bags (shadows) under eyes are often seen in the under-eye area EK. Below, the same reference numbers as those in FIGS. 1 through 16 are assigned to the corresponding components in FIGS. 17 through 24, and descriptions of those components are omitted.

The massaging device 10B includes a base part 11B having a shape corresponding to the shape of a part of the face near the eyes of the user A, and vibrators 12E and 12F.

Two sets of the vibrators 12E and 12F are symmetrically arranged with respect to the center (corresponding to the center position between the eyes of the user A wearing the massaging device 10B) of the base part 11B. For brevity and clarity, one set of the vibrators 12E and 12F on one side (right side in the figures) are described below.

Figure 18:
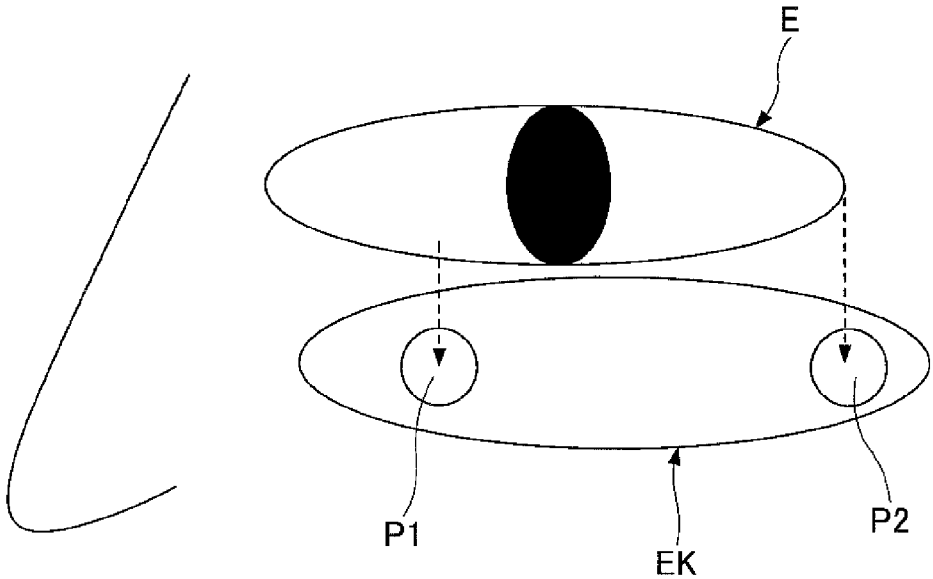
FIG. 18 is a drawing illustrating positions in an under-eye area at which skin stress is measured.

Before producing the massaging device 10B of the second embodiment, skin stress in the under-eye area EK was measured. More specifically, as illustrated in FIG. 18, skin stress was measured at a position P1 under the eye E and between the inner corner and the center of the eye E, and at a position P2 below the outer corner of the eye E. The inventors conducted an experiment to measure the skin stress in the under-eye areas EK of experimental subjects illustrated in FIG. 19(A) through FIG. 24(A) using a force gauge in a manner similar to the first embodiment.

The results of the experiment are illustrated in FIGS. 19(B) through 24(B). As in the first embodiment, the measurements are classified into four ranges: less than 0.1 g (soft), greater than or equal to 0.1 g and less than 0.2 g (relatively soft), greater than or equal to 0.2 g and less than 0.3 g (relatively hard), and greater than or equal to 0.3 g (hard). The ranges are indicated by shading.

In this example, the massaging device 10B is configured based on the measurements of the experimental subject of FIG. 24. The skin stress of the experimental subject of FIG. 24 (hereafter referred to as the user A) is 0.25 g at the position P1 and 0.30 g at the position P2. Here, the relationship between the skin stress of the face and the wire diameter and the spring constant of a coil spring illustrated in FIG. 15 is also applicable in the second embodiment.

Therefore, for a coil spring 14E of the vibrator 12E corresponding to the position P1, the wire diameter is set at a value greater than or equal to 0.65 mm and less than 0.75 mm (in this embodiment, 0.7 mm) and the spring constant is set a value greater than or equal to 0.4 N/mm and less than 1.0 N/mm, which correspond to the relatively hard area with skin stress greater than or equal to 0.2 g and less than 0.3 g. Meanwhile, for a coil spring 14F of the vibrator 12F corresponding to the position P2, the wire diameter is set at a value greater than or equal to 0.75 mm (in this embodiment, 0.8 mm) and the spring constant is set a value greater than 1.0 N/mm, which correspond to the hard area with skin stress greater than or equal to 0.3 g.

With these settings, it is possible to improve the flow of blood in the epidermis in the under-eye area EK and thereby remove bags under eyes.

Preferred embodiments of the present invention are described above. However, the present invention is not limited to the specifically disclosed embodiments, and variations and modifications may be made without departing from the scope of the present invention. Also, parts of two or more of the above embodiments may be combined to form another embodiment.

The present international application claims priority from Japanese Patent Application No. 2009-290418 filed on Dec. 22, 2009, the entire contents of which are hereby incorporated herein by reference.

Explanation of References

10A, 103 Massaging device
11A, 11B Base part
12, 12A-12F Vibrator
13 Fixed part
14, 14A-14F Coil spring
15 Vibrating motor
17 Contact part
A User
AA Skin
E Eye
EK Under-eye area

The invention claimed is:

1. A massaging device, comprising:

a base part;

a plurality of vibrators configured to be brought into contact with target parts of a user and to massage the target parts with vibration; and a plurality of springs each including a first end fixed to the base part and a second end attached to a corresponding one of the vibrators, wherein the springs have different spring constants that are set based on skin stress obtained by pressing skin of the target parts, wherein each of the vibrators includes plural protrusions formed thereon to contact a corresponding one of the target parts and the protrusions are arranged at intervals greater than or equal to 1 mm and less than or equal to 5 mm, and wherein the spring constant of a first spring of the springs corresponding to a first target part of the target parts of an area on and near a cheek bone of the user is greater than or equal to 1.0 N/mm, the spring constant of a second spring of the springs corresponding to a second target part of the target parts of an area on and near an upper jawbone of the user is greater than 0.4 N/mm and less than 1.0 N/mm, the spring constant of a third spring of the springs corresponding to a third target part of the target parts of an area on and near a lower jawbone of the user is greater than or equal to 0.2 N/mm and less than 0.4 N/mm, and the spring constant of a fourth spring of the springs corresponding to a fourth target part of the target parts between the lower jawbone and the upper jawbone of the user is less that 0.2 N/mm.

2. The massaging device as claimed in claim 1, wherein the fourth target part having skin stress that is obtained by pressing the skin and smaller than the skin stress of the first, second and third target parts.

3. The massaging device as claimed in claim 1, wherein an inner surface of the base part has a shape corresponding to a shape of a human face.

4. The massaging device as claimed in claim 1, wherein a heater is provided on each of the vibrators.

5. The massaging device as claimed in claim 1, wherein the first spring, the second spring, the third spring, and the fourth spring have different wire diameters, outside diameters and free lengths.

* * * * *